US005513577A

United States Patent [19]

Weis

[11] Patent Number: 5,513,577

[45] Date of Patent: May 7, 1996

[54] ADJUSTABLE PALLET LEG

[76] Inventor: Jack E. Weis, 8431 Scandia Trial North, Forest Lake, Minn. 55025

[21] Appl. No.: 255,041

[22] Filed: Jun. 7, 1994

[51] Int. Cl.[6] ..... B65D 19/12

[52] U.S. Cl. ..... 108/56.3; 108/53.1

[58] Field of Search ..... 108/56.3, 56.1, 108/51.1, 51.3, 53.1

[56] References Cited

U.S. PATENT DOCUMENTS

| | | | |
|---|---|---|---|
| 2,611,659 | 9/1952 | Coleman et al. | 108/51.3 |
| 2,918,241 | 12/1959 | Maher | 108/56.3 X |
| 3,915,099 | 10/1975 | Wies et al. | 108/56.3 |
| 4,267,781 | 5/1981 | Powers | 108/56.3 X |
| 4,604,014 | 8/1986 | Frano | 108/56.3 X |
| 5,351,629 | 10/1994 | Breezer et al. | 108/56.3 |

FOREIGN PATENT DOCUMENTS

| | | | |
|---|---|---|---|
| 2236945 | 2/1974 | Germany | 108/56.3 |
| 630130 | 11/1978 | U.S.S.R. | 108/56.3 |

*Primary Examiner*—José V. Chen

*Attorney, Agent, or Firm*—Nawrocki, Rooney & Sivertson

[57] ABSTRACT

A pallet leg, including a riser portion having a first end and second end and a generally cylindrical fastening ring having an outwardly extending flange. The riser portion includes a flange extending outwardly from the riser portion proximate the first end. The riser portion and fastening ring are secured to each other such that the riser portion is firmly fastened to a pallet deck disposed between the flange extending from the riser portion and the flange extending from the fastening ring. The pallet leg may also include a second generally cylindrical fastening ring for fastening a second pallet deck to the second end of the riser portion.

14 Claims, 3 Drawing Sheets

ADJUSTABLE PALLET LEG

BACKGROUND OF THE INVENTION

The present invention pertains generally to pallets and particularly to legs for supporting one or more pallet decks.

Pallets are commonly used for movement of goods within a warehouse or storage area, to or from a shipping point or in transshipment. A pallet typically has a generally planar top surface or support deck supported above the ground by, for example, a plurality of pallet legs. A second generally planar surface or deck may be disposed in spaced relation to the support deck. Goods to be transported are stacked or arranged on the support deck.

The legs of a pallet maintain the support deck sufficiently above the ground (or from the second deck, when present) to allow a forklift to engage the pallet under the support deck. Other means of similarly lifting the pallet are well known.

Prior pallet support legs include those disclosed by Wies, et al. in U.S. Pat. No. 3,915,099 which includes a riser portion having circumferentially disposed flanges disposed between a first and a second end of the riser portion proximate the first end. A plurality of tabs extend from the first end approximately parallel to the flanges. The pallet deck disclosed by Wies, et al. includes an opening for inserting each riser portion. Each opening is generally circular and includes radially extending side openings corresponding to the configuration of the tabs.

In use, the first end of the Wies, et al. riser is inserted through the deck opening with the tabs being inserted through the side openings until the flanges are adjacent one side of the pallet deck. The leg is then rotated relative to the pallet deck until the deck is disposed between and adjacent the tabs and the flanges. The distance between the tabs and flanges is approximately equal to the thickness of the pallet deck. Thus, each nominal pallet deck thickness requires a different pallet leg having a relatively greater or lesser spacing between the tabs and the flanges. Also, such legs cannot accommodate significant variations in nominal thickness within a given pallet deck or from deck to deck.

SUMMARY OF THE INVENTION

The present invention provides an improved pallet leg capable of being quickly attached to pallet decks of various nominal thicknesses while easily accommodating variations in nominal thickness from deck to deck or even variations within a given deck. The pallet leg of the present invention may be configured for use with a single pallet deck or with two spaced pallet decks. In either case, however, a pallet leg in accordance with the present invention eliminates the need for different pallet legs for pallet decks of different, or varying thicknesses.

The pallet leg of the present invention includes a riser portion having a first end and a second end. The riser portion may be generally hollow and have an annular cross-section. A peripheral flange extends outwardly from the riser portion proximate the first end. The riser portion may also include a bushing extending from the first end and generally conforming to an inside surface of an opening through the deck.

In accordance with a preferred embodiment, the leg includes a generally cylindrical fastening ring having an outwardly extending peripheral flange. The riser portion is engaged by the fastening ring through the support deck such that the riser portion is firmly secured to the pallet deck.

Engagement between the riser portion and the fastening ring may be by way of cooperating threads.

In a preferred embodiment in accordance with the present invention at least two thread sets, each including two or more approximately parallel threads, are disposed around the outside surface of the fastening ring. The riser portion includes at least two circumferentially spaced threads disposed on an inside surface.

The leg of the present invention is secured to the pallet by aligning the fastening ring and riser portion on opposite sides of the deck with their respective thread sets and spaced threads engaging each other. That is, when the fastening ring is inserted into the riser portion through the deck, the thread sets are inserted between the circumferentially spaced threads until the flange of the riser portion and the flange of the fastening ring are adjacent opposite sides of the pallet deck. Then the fastening ring and riser portion are rotated relative to each other to engage the threads of the fastening ring with the threads on the riser portion. It is anticipated that the thread sets may be fabricated on the riser portion (rather than the fastening ring) with the circumferentially spaced threads fabricated on the fastening ring (rather than the riser portion).

A pallet leg in accordance with the present invention may also include a similar structure including cooperating thread sets and spaced threads proximate the second end of the riser. In a preferred embodiment, the riser bottom may form an inwardly extending flange. A second generally cylindrical fastening ring may be provided having a peripheral flange extending outwardly. The riser portion may be adapted to be fastened to the second fastening ring to firmly secure a second pallet deck between the flange extending from the second end of the riser portion and the flange extending from the second fastening ring.

A pallet leg in accordance with the present invention may also include a deck edge/corner support and edge protector operably connected to the riser portion. The support includes a flange extension configured to underlie the deck and extend to an edge of the deck when the pallet leg is fastened to the deck. The support/flange extension may be configured to extend to the joining edges of a corner of the deck when the pallet leg is fastened to the deck. A lip may be provided on the support/flange extension to lie along the edge of the pallet leg for additional protection.

DETAILED DESCRIPTION OF THE INVENTION

Figure 1:
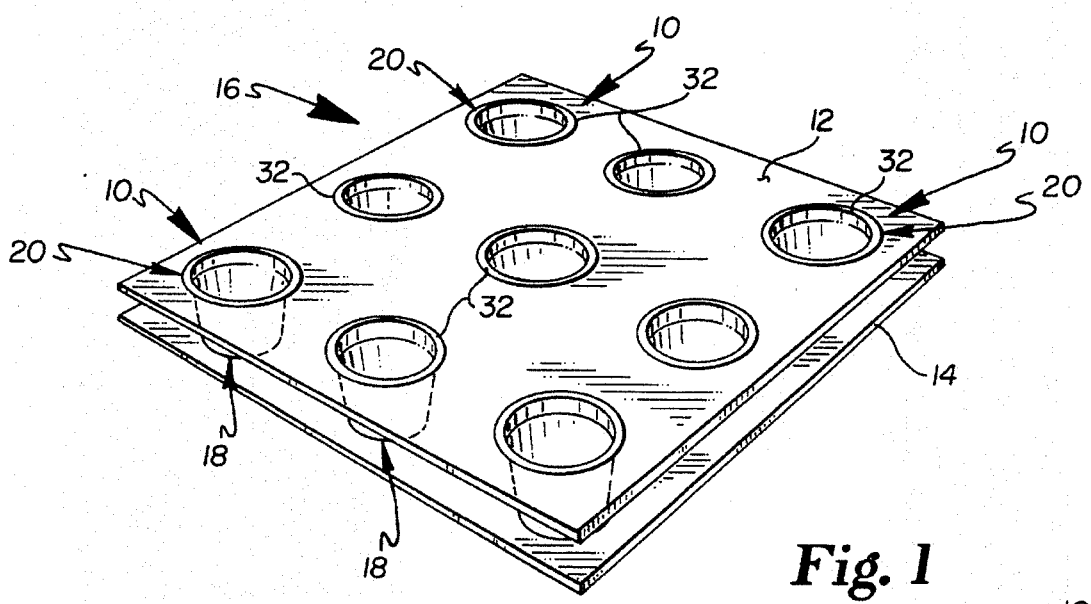
FIG. 1 shows a pallet including two pallet decks and nine pallet legs in accordance with the present invention.

Referring now to the drawings wherein like reference numerals designate like elements throughout the several views, FIG. 1 shows a plurality of pallets legs 10 in accordance with the present invention. As shown in FIG. 1, pallet legs 10 are fastened to first and second pallet decks 12 and 14 respectively to form a pallet 16.

Pallet legs 10 are capable of being quickly attached to pallet decks 12 and 14 of various thicknesses. Legs 10 of the present invention may be used with a single pallet deck or with two spaced pallet decks as shown in FIG. 1. Whether or not pallet legs 10 are used with a single pallet deck or two, pallet legs 10 can be used with pallet decks of various thicknesses, eliminating the need for different pallet legs for pallet decks of different thicknesses.

Figure 2:
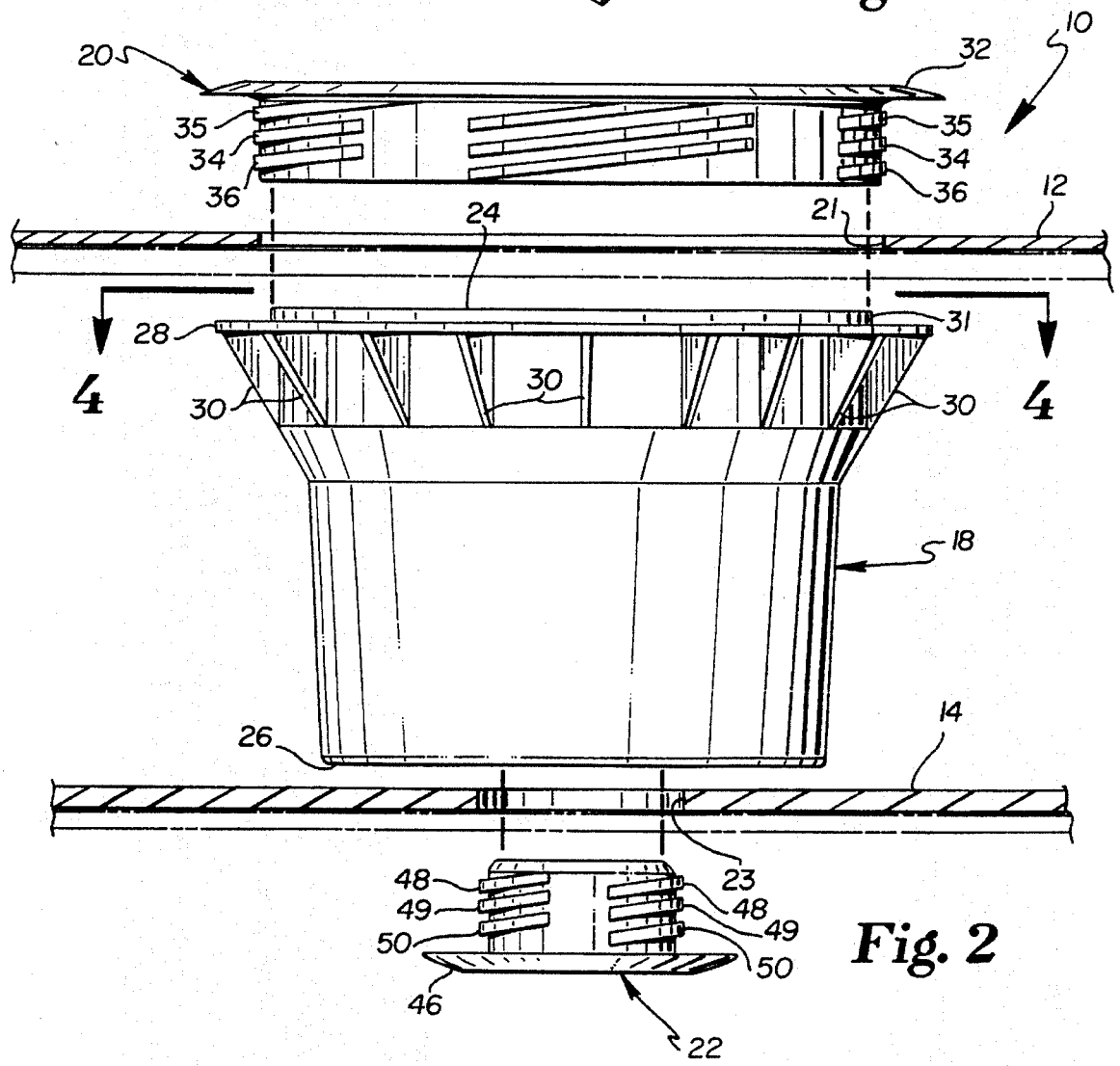
FIG. 2 shows an exploded side view of a pallet leg in accordance with the present invention and two pallet decks.
Figure 3:
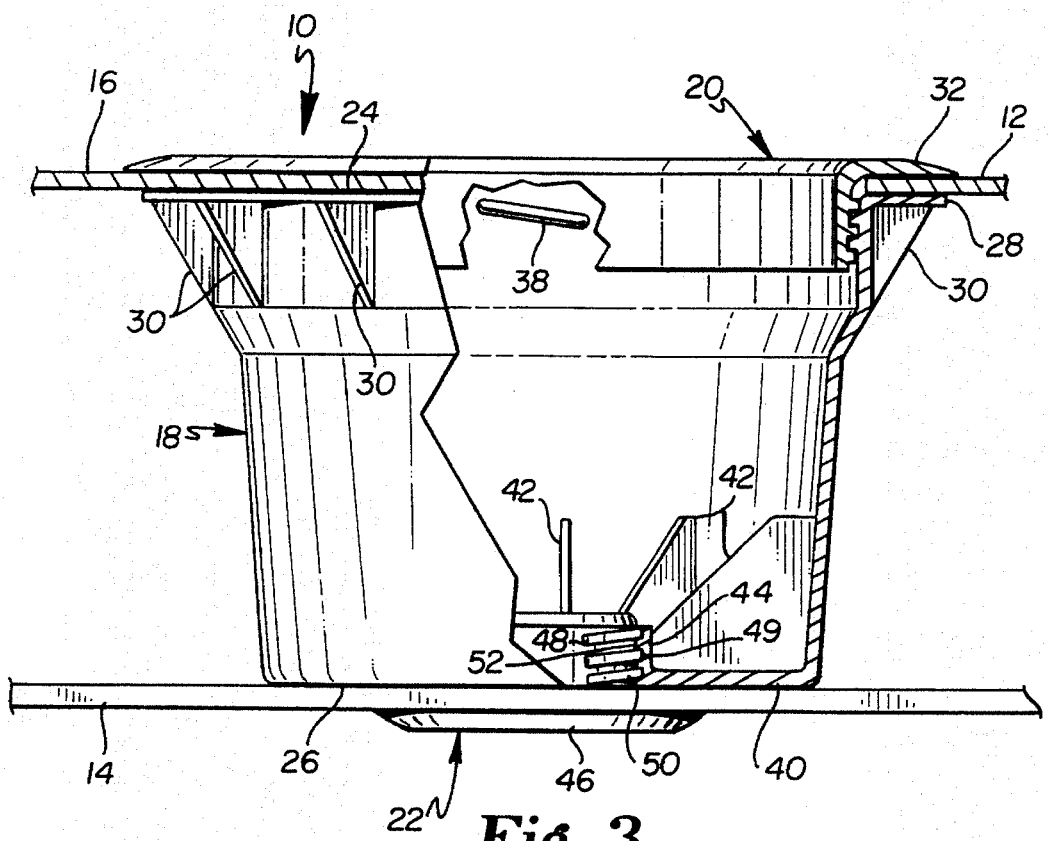
FIG. 3 shows a side partial cut-away view of a pallet leg in accordance with the present invention and two pallet decks.
Figure 4:
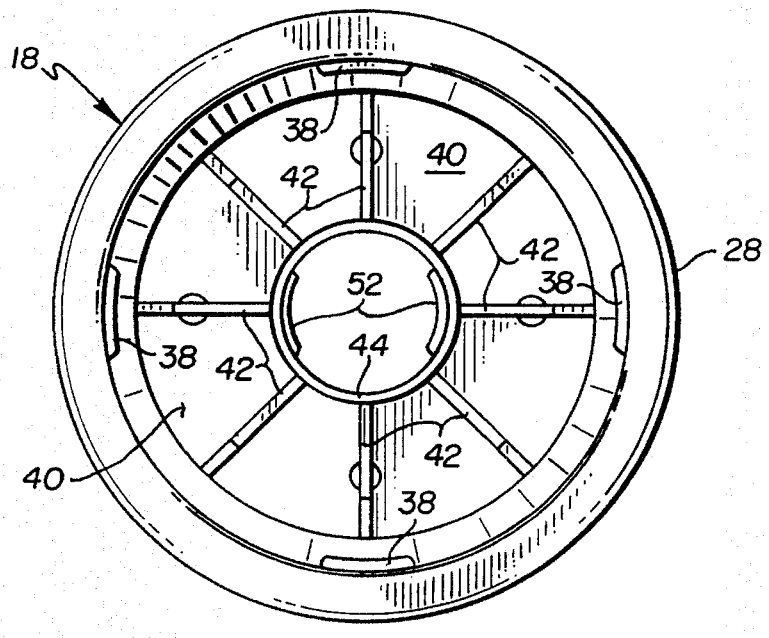
FIG. 4 shows a top view of the pallet leg of FIGS. 2 and 3.

A pallet leg 10 is shown in more detail in FIGS. 2–4. FIG. 2 shows an exploded side view of leg 10 and pallet decks 12 and 14. Pallet leg 10 may include a riser portion 18 and a first fastening ring 20 and second fastening ring 22 insertable through opening 21 in deck 12 and opening 23 in deck 14, respectively. Riser portion 18 and fastening rings 20 and 22 are preferably made of blow molded plastic. Other sufficiently strong and durable materials can also be used and are known in the art.

Riser portion 18 has a first end 24 and a second end 26. Riser portion 18 is preferably hollow and has a generally annular cross-section. A bushing 31, generally conforming to an inside surface of opening 21, may extend from first end 24.

A peripheral flange 28 extends outwardly from riser portion 18 proximate first end 24. In the embodiment illustrated in FIGS. 2–4, flange 28 is annular, having generally circular inner and outer edges, the inner edge corresponding to the preferred cross-section of riser portion 18. Suitable reinforcement of flange 28 may be provided to prevent the collapse of flange 28 under load, such as triangular webs 30 as shown in FIG. 2.

First fastening ring 20 is preferably generally cylindrical, and preferably includes a peripheral flange 32 extending outwardly. Peripheral flange 32 may be annular, generally corresponding to the flange 28 of the riser portion 18.

Second fastening ring 22, like first fastening ring 20, is preferably cylindrical and includes a peripheral flange 46 extending outwardly. Peripheral flange 46 is preferably annular.

Pallet leg 10 includes means for fastening riser portion 18 to fastening ring 20 through opening 21 of deck 12. When the means for fastening the riser portion 18 to fastening ring 20 is engaged, pallet leg 10 is firmly fastened to deck 12, the deck 12 being disposed between flanges 28 and 32 of riser 18 and fastening ring 20 respectively.

A preferred means for fastening riser portion 18 to fastening ring 20 includes at least two, and preferably four, sets of threads disposed (circumferentially spaced) around an outside surface of fastening ring 20. For example, each thread set includes approximately parallel threads 34, 35 and 36 arranged at a slight acute angle to flange 32 of fastening ring 20.

As shown in FIGS. 3 and 4, the means for fastening riser portion 18 to fastening ring 20 also includes at least two, but preferably four, Circumferentially spaced threads 38 disposed on an inside surface of riser portion 18. Threads 38 are preferably disposed at a slight acute angle to flange 28 of riser portion 18. Alternatively, it is anticipated that threads may be arranged in sets around the inside surface of riser portion 18 and circumferentially spaced threads, such as 38, could be placed around an outside surface of fastening ring 20. Generally, the number of thread sets on one member will correspond with the number of spaced threads on the other member with the length of the spaced threads being less than the spacing between thread sets. Such that the spaced threads will pass between the thread sets.

As shown in FIGS. 3 and 4, a bottom surface of pallet leg 10 may be considered to be a flange 40 extending inwardly from riser portion 18 proximate second end 26 of riser portion 18. Flange 40 is preferably reinforced by suitable reinforcing members such as trapezoidal webs 42. A generally cylindrical member 44 (discussed more fully below) is preferably disposed proximate an end of flange 40 opposite riser portion 18. Cylindrical member 44 is also preferably reinforced and held in position by webs 42.

Pallet leg 10 may also include means for fastening riser portion 18 to a second deck 14 via second fastening ring 22. When pallet leg 10 is fastened to deck 14, deck 14 is disposed between flange 40 extending from second end 26 of riser portion 18 and flange 46 extending from second fastening ring 22.

The riser portion 18 may be secured to deck 14 in a manner similar to its fastening to deck 12, including a second fastening ring or plug 22. As illustrated, plug 22 includes at least two circumferentially spaced thread sets 48 and 49 disposed on an outside surface. Thread sets 48 and 49 preferably each include at least two approximately parallel threads 50 disposed at a slight acute angle to flange 46 of plug 22—four threads 50 being illustrated.

Means for fastening riser portion 18 to fastening ring or plug 22 also includes at least two threads 52 circumferentially disposed around the inside surface of cylindrical member 44. Threads 52 are preferably disposed at a slight acute angle to flange 40. Alternatively, it is anticipated that thread sets 48 and 49 could be placed on cylindrical member 44 and threads 52 could be placed on the outside surface of fastening ring 22.

As best shown in FIG. 2, pallet leg 10 can be fastened to deck 12 (shown having variable thickness by dashed lines). To fasten pallet leg 10 to deck 12, bushing 31 is aligned with, and may be inserted through, opening 21 of deck 12 until peripheral flange 28 of riser portion 18 is adjacent a first side of deck 12. Then, fastening ring 20 is inserted from a second side of deck 12 through opening 21 and into riser portion 18 until flange 32 is adjacent the second side of deck 12. It is apparent that during this insertion, the space between thread sets are aligned with the threads 38 such that the flanges 28 and 32 contact the deck 12. Thereafter, ring 20 and riser portion 18 may be rotated relative to each other to engage threads 34, 35 or 36 of the thread sets with the threads 38 to fasten ring 20 to riser 18. Which of the threads 34, 35 or 36 is engaged by the threads 38 is determined by the thickness of the deck 12. Also, the inclination of the threads allows for a "tight" securement of the pallet leg to the deck while accommodating variations in nominal deck thickness. The position of the threads in each thread set and number of threads in each thread set is selected in accordance with the nominal deck thicknesses, and the number of such nominal deck thicknesses, it is desired to accommodate. Pallet leg 10 can be fastened to various thickness second decks 14 in a similar way.

Figure 5:
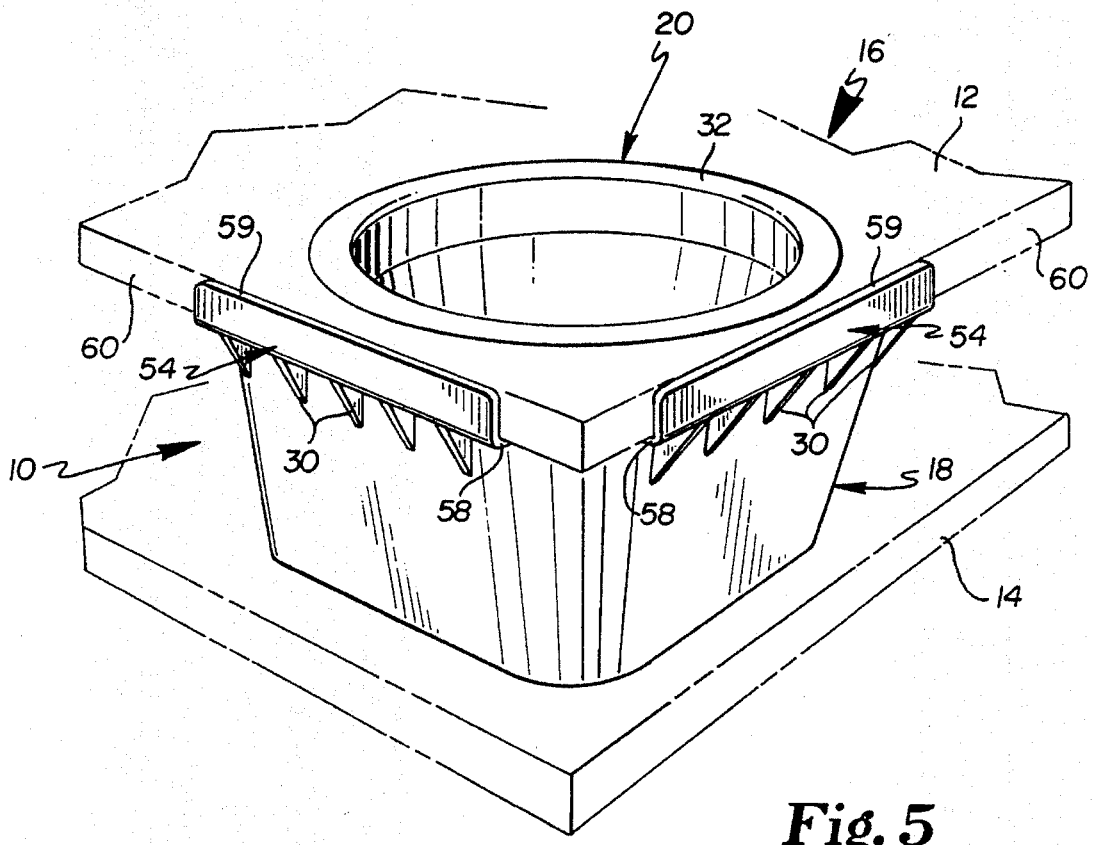
FIG. 5 shows an alternate embodiment of a pallet leg in accordance with the present invention including deck edge protectors.
Figure 6:
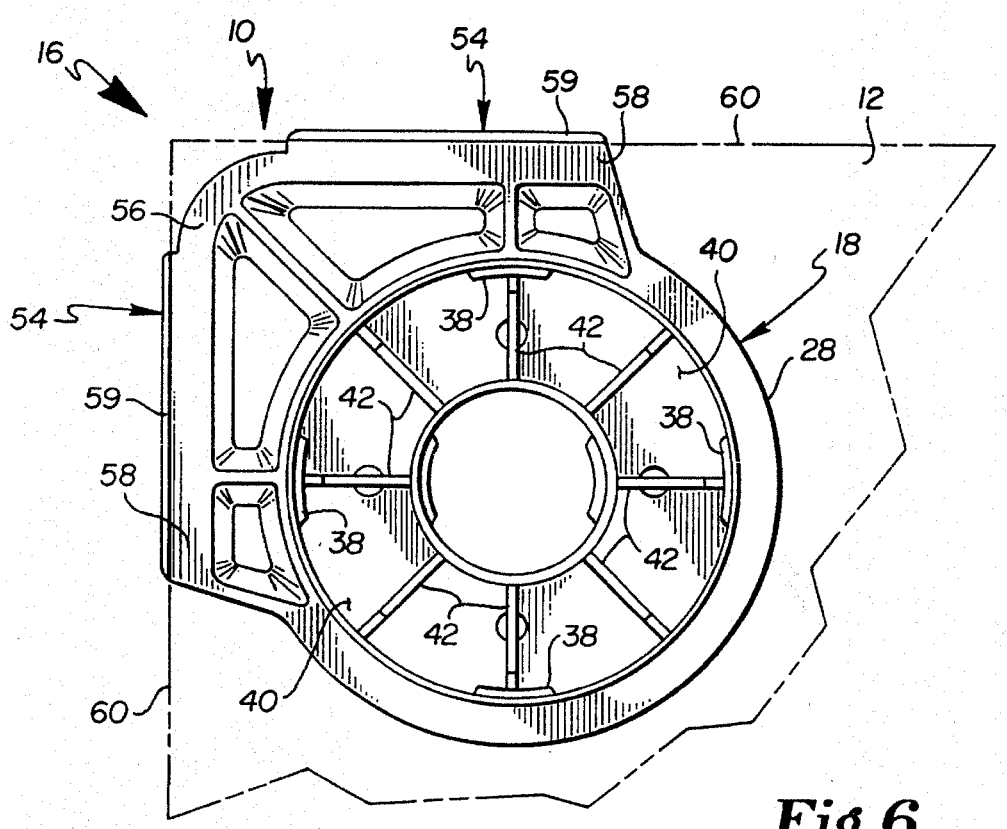
FIG. 6 shows an end view of the alternate embodiment of the pallet leg shown in FIG. 5.

As shown in FIGS. 5 and 6 an alternate embodiment of a pallet leg 10' may have an edge support 54 operably connected to a riser portion 18'. Edge support 54 includes an extension 56 of a peripheral flange 28'. Flanges 28' and 56 may be reinforced by supports such as triangular webs 30'.

For use at a corner, as illustrated in FIGS. 5 and 6, flange 56 may be formed by flanges 58 which extend at approximately right angles to underlie the deck 12. Flanges 58 may be configured and arranged to be aligned with and be adjacent to an edge 60 of deck 12 when leg 10' is fastened to deck 12. Edge support 54 may also include one or more lips 59 configured and arranged to be aligned with and adjacent joining edges 60 of a corner of deck 12 when the leg 10' is fastened to deck 12.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A pallet leg, comprising:

a riser portion having a first end and a second end;

a peripheral flange extending outwardly from the riser portion proximate the first end;

a generally cylindrical fastening ring having an outwardly extending peripheral flange;

means for fastening the riser portion to the fastening ring while accommodating pallet decks of varying thickness between the riser portion flange and the fastening ring flange, the means for fastening being adapted to fasten the fastening ring to the riser portion through an opening through a deck; and a deck edge support operably connected to the riser portion, the edge support including a flange configured to underlie a deck adjacent an edge thereof when the riser portion is fastened to a deck.

2. A pallet leg, in accordance with claim 1, wherein the means for fastening includes at least two thread sets disposed on an outside surface of the fastening ring, the riser portion including at least two spaced threads disposed on an inside surface such that the fastening ring can be inserted into the riser portion with the thread sets inserted between the spaced threads until the flange of the riser portion and the flange of the fastening ring are adjacent opposite sides of the pallet deck, and the fastening ring being rotatable relative to the riser to engage the thread sets with the threads.

3. A pallet leg, in accordance with claim 1, further comprising:

a flange extending inwardly from the riser portion proximate the second end of the riser portion;

a second generally cylindrical fastening ring having a peripheral flange extending outwardly from the fastening ring; and means for fastening the riser portion to the second fastening ring while accommodating second pallet decks of varying thickness between the flange extending from the second end of the riser portion and the flange extending from the second fastening ring, the means for fastening the riser portion to the second pallet deck being adapted to fasten the riser portion to the second ring through an opening in the second pallet deck.

4. A pallet leg, in accordance with claim 3, wherein the means for fastening the riser portion to the second fastening ring includes at least two thread sets disposed on an outside surface of the second fastening ring, the riser portion including at least two spaced threads disposed on an inside surface of the riser portion such that the fastening ring can be inserted into the riser with the thread sets inserted between the spaced threads until the flange proximal the second end of the riser and the flange of the second fastening ring are adjacent opposite sides of the pallet deck, and the second fastening ring being rotatable relative to the riser portion to engage the thread sets with the threads.

5. A pallet leg, in accordance with claim 1, wherein the edge support includes a flange configured to underlie a corner of a deck when the riser portion of the leg is fastened to a deck.

6. A pallet leg, in accordance with claim 1, wherein the riser portion is generally hollow.

7. A pallet leg, in accordance with claim 6, wherein the riser portion has a generally annular cross-section.

8. A pallet leg, in accordance with claim 1, wherein the riser portion includes a bushing generally conforming to a deck opening.

9. A pallet leg, comprising:

a riser portion having two ends;

a flange extending inwardly from the riser portion proximate one end;

a generally cylindrical fastening ring having an outwardly extending flange;

means for fastening the riser portion to the fastening ring while accommodating pallet decks of varying thickness between the riser portion flange the fastening ring flange, the means for fastening being adapted to fasten the fastening ring to the riser portion through an opening in a deck; and a deck edge support operably connected to the riser portion, the edge support including a flange configured to underlie a deck adjacent an edge thereof when the riser portion is fastened to a deck.

10. A pallet leg, in accordance with claim 9, wherein the means for fastening includes at least two spaced sets of threads disposed on an outside surface of the fastening ring, the riser portion including at least two spaced threads disposed on an inside surface such that the fastening ring can be inserted into the riser portion with the thread sets inserted between the spaced threads until the flange of the riser and the flange of the fastening ring are adjacent opposite sides of the pallet deck, and the fastening ring being rotatable relative to the riser portion to engage the thread sets with the threads.

11. A pallet leg, in accordance with claim 9, wherein the edge support includes a flange configured to underlie a corner of a deck.

12. A pallet leg, in accordance with claim 9, wherein the riser portion is generally hollow.

13. A pallet leg, in accordance with claim 12, wherein the riser portion has a generally annular cross-section.

14. A pallet leg, in accordance with claim 9, wherein the riser portion includes a bushing generally conforming to an inside surface of a deck opening.

* * * * *